US006671479B2

(12) United States Patent
Grenek et al.

(10) Patent No.: US 6,671,479 B2
(45) Date of Patent: Dec. 30, 2003

(54) SELECTIVE DEPOPULATION AND/OR REPOPULATION OF A FULL COLOR IMAGE FORMING DEVICE

(75) Inventors: Heidi M. Grenek, Fairport, NY (US); Naveen G. Sharma, Perinton, NY (US); David G. Wilcox, Dundee, NY (US)

(73) Assignee: Xerox Corporation, Stamford, CT (US)

( * ) Notice: Subject to any disclaimer, the term of this patent is extended or adjusted under 35 U.S.C. 154(b) by 58 days.

(21) Appl. No.: 10/063,940

(22) Filed: May 28, 2002

(65) Prior Publication Data

US 2003/0223781 A1 Dec. 4, 2003

(51) Int. Cl.[7] ..... G03G 15/00
(52) U.S. Cl. ..... 399/223; 399/231

(58) Field of Search ..... 399/223, 238; 358/296

(56) References Cited

U.S. PATENT DOCUMENTS 2,297,691 A 10/1942 Carlson
6,108,017 A * 8/2000 Katakura et al. ..... 347/115

FOREIGN PATENT DOCUMENTS

JP 9-277608 * 10/1997

* cited by examiner

*Primary Examiner*—Quana M. Grainger
(74) *Attorney, Agent, or Firm*—Oliff & Berridge, PLC

(57) ABSTRACT

The selective depopulation and/or repopulation of a full color image-next-to-image or image-on-image print engine for generating monochrome and/or highlight color images, utilizing a multiplicity of functionally-equivalent substations in tandem to compensate for the increase in printing speed.

15 Claims, 9 Drawing Sheets

SELECTIVE DEPOPULATION AND/OR REPOPULATION OF A FULL COLOR IMAGE FORMING DEVICE

BACKGROUND OF THE INVENTION

1. Field of the Invention

This invention relates to systems and methods for generating monochrome and/or highlight color images at high speed.

2. Description of Related Art

In electrophotographic printing, a photoconductive surface is charged, and is then selectively exposed to image data to selectively discharge portions of the charged photoconductive surface. This forms a latent electrostatic image on the photoconductive surface. Charged toner material is then applied to the latent-image-bearing portion of the photoconductive surface to convert the latent electrostatic image into a developed image.

In full color image-on-image systems, this process is repeated a number of times to build a multi-layer full color image. This developed, or toner, image is then transferred, either directly, or indirectly via a transfer member, to a sheet of recording material. The developed, or toner, image is then at least semi-permanently fixed to the sheet of recording material. An example of this process is more fully described in U.S. Pat. No. 2,297,691.

In the image-on-image technique, a first latent toner image is developed onto a portion of the photoconductive surface. Subsequent latent toner images are exposed through the first image, on the same portion of the photoconductive surface, and then developed.

Different color features of an input image are formed at separate stations of the image forming device. Each station typically contains a charging substation, an exposing substation and a developing substation. These stations and substations are arranged around, and can be strategically spaced relative to, the photoconductive surface. Thus, in such image forming devices, the photoconductive surface is often a photoconductive belt. The speed that the belt moves past these different stations can be strategically set to allow adequate time for: 1) uniform charging of the photoconductive surface, 2) sufficient exposing of the latent image and 3) sufficient developing of the image.

Commercial demands require the reliable, high-speed production of quality images. Most full color image forming devices are capable of printing about 40–80 pages per minute. More sophisticated full color image forming devices can print up to 100 pages per minute.

SUMMARY OF THE INVENTION

Current full color xerographic image forming devices are able to form monochrome and highlight color images, but only at the lower full color rate, as the operating speed of such image forming devices is optimized for full color printing. Additionally, each station is dedicated to creating and developing a single color of toner.

However, the inventors have recognized that, when printing monochrome or highlight color images, various charging, exposing and/or developing substations of different color stations that are not being used, because the image does not contain that color toner, could be used in tandem with other charging, exposing and/or developing substations from other stations, to allow an increase in the process speed. Moreover, those stations and/or substations that are not being used can be physically absent or functionally-omitted in the monochrome and/or highlight color image forming device. For example, a full color xerographic image forming device can be converted to a dedicated monochrome or highlight color image forming device by physically or functionally removing some substations of the now-unused color toner stations. The remaining substations of the currently-unused color toner stations can now be used in tandem with some of the substations of the in-use color stations to allow an increase in the process speed.

This invention relates to selectively depopulating and/or repopulating a full color image forming device.

This invention also relates to using a multiplicity of charging substations in tandem to uniformly charge the photoconductive surface.

This invention also relates to using a multiplicity of developing substations in tandem to develop a single latent image.

This invention provides an image forming device having a set of image forming substations that have been selectively depopulated and/or repopulated relative to a full color image forming device.

This invention also relates to using multiple, functionally-equivalent, substations in tandem to perform charging, exposing, and/or developing actions on a photoconductive surface of a selectively depopulated and/or repopulated full color image forming device.

This invention separately provides systems and methods for selectively depopulating a full color image forming device and for generating the depopulated image forming device according to a set of operating parameters that allow higher speed printing of monochrome and/or highlight color images.

This invention separately provides a depopulated and/or repopulated image forming device that includes:

In various exemplary embodiments of the systems and methods according to this invention, substations, or even entire stations, of a full color image forming device can be removed from that full color image forming device to generate monochrome and/or highlight color images at a higher printing speed. As a result, the photoconductive surface does not spend time at stations and/or substations that are not needed to produce the monochrome and/or highlight color images of interest.

In various exemplary embodiments, a depopulated and/or repopulated image forming device is formed by physically omitting stations and/or substations relative to the stations and substations that are included on a full color image forming device. Additionally, stations and/or substations that are not normally included, or arranged differently, in the full color image forming device can be included to form a repopulated image forming device.

In various other exemplary embodiments, a depopulated and/or repopulated image forming device is functionally obtained from a full color image forming device by using an operation control scheme that functionally omits some of the stations and/or substations that are physically present in the full color image forming device and usually functionally active when forming full color images. Additionally, stations and/or substations that are physically present in the full color image forming device, but that are not necessarily functionally active when forming full color images, can become active under this operations control scheme to repopulate the depopulated image forming device.

In various other exemplary embodiments of the systems and methods according to this invention, multiple, functionally-equivalent, substations from different stations of a selectively depopulated and/or repopulated full color print engine can act in tandem to perform their function on a single portion of the photoconductive surface. As a result, the photoconductive surface can spend less time at a particular substation and still generate a monochrome or highlight color image having sufficient image quality, by making up for charging, exposing and/or developing deficiencies occurring in one substation with one or more other substations along the photoconductive belt. In this way, a single portion of the photoconductive surface may be charged, exposed and/or developed, multiple times in tandem, using different substations.

In addition to selectively depopulate and/or repopulate the print stations that are arranged along the circumference of the photoconductive surface, various exemplary embodiments of the systems and methods according to this invention use image-next-to-image printing. With image-next-to-image printing, different toner images are exposed onto different portions of the photoconductive surface. As a result, image generation can occur at a fast rate, because there is no need to expose through previously-developed toner images.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

Figure 1:
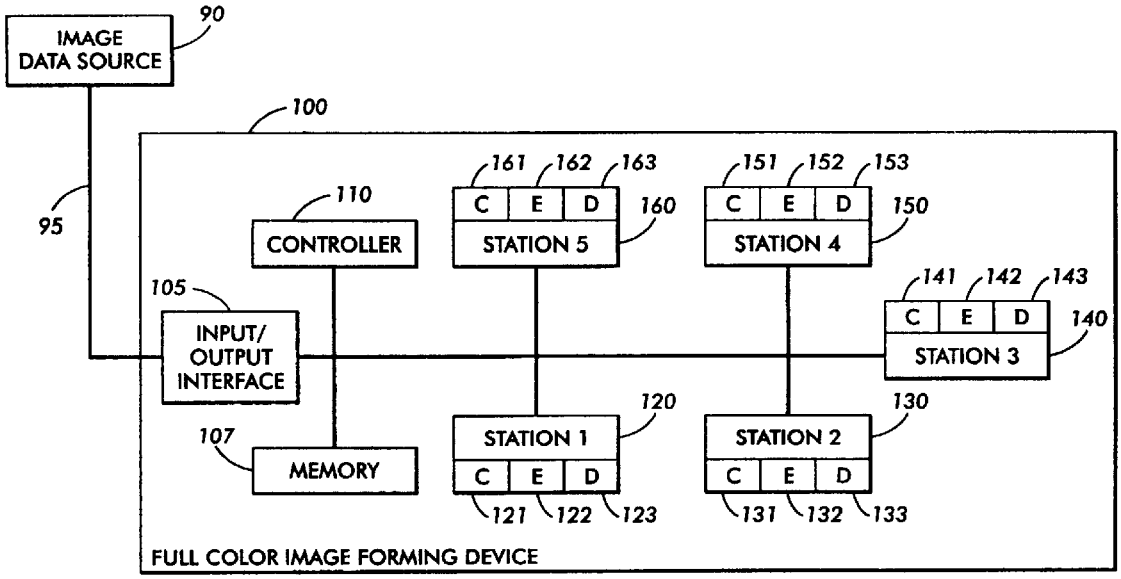
FIG. 1 (PRIOR ART)
FIG. 1 is a block diagram outlining the elements of a known full color image forming device.

In various exemplary embodiments, an image forming device can be depopulated and/or repopulated by removing or adding stations and/or substations to generate monochrome and/or highlight color images. Each station of the full color print engine can be selectively depopulated and/or repopulated with a charging substation, exposing substation and/or developing substation. The rate of generation of a final image can be increased by increasing the speed of the belt. The increase in belt speed necessarily leads to the images spending less time in each individual substation. This decrease in time spent in an individual substation is compensated for by moving the photoconductive surface through multiple functionally-equivalent substations that work in tandem to generate an image, and by the spacing of the substations along the photoconductor belt.

In various exemplary embodiments, the depopulated and/or repopulated image forming device may involve the physical addition or removal of various substation relative to a full color image forming device. In various other exemplary embodiments, the depopulated and/or repopulated image forming device may involve an operation control scheme that functionally omits or includes various substations that are physically present in the image forming device.

In various exemplary embodiments, an image forming device can be depopulated, relative to a full color image forming device, for monochrome printing. The depopulated image forming device may contain three charging substations, one exposing substation and two developing substations, for example. The multiple charging stations work in tandem to ensure uniform charge of the photoconductive surface, thus compensating for the decrease in time spent at the individual charging substations. Similarly, the multiple development substations work in tandem to ensure sufficient development of a single latent image, thus compensating for the decrease in time spent at the individual developing substations. As a result, the rate of image generation can be increased to approximately 225–240 pages per minute. In various other exemplary embodiments, speeds greater than 240 pages per minute may be reached.

In various exemplary embodiments, an image forming device can be depopulated, relative to a full color image forming device, for monochrome and/or single highlight color printing. The depopulated image forming device may contain two charging substations, one exposing substation and one developing substation for the highlight color feature of the image and two charging substations, one exposing substation and two developing substations for the monochrome feature of the image, for example. As a result, the rate of image generation can be increased to approximately 133–166 pages per minute. In various other exemplary embodiments, speeds greater than 166 pages per minute may be reached. As mentioned above, the multiplicity of functionally-equivalent substations working in tandem to generate a single image compensates for the increased belt rate and subsequent decrease in time spent at a particular substation.

In various exemplary embodiments, an image forming device can be depopulated, relative to a full color image forming device, for monochrome, single highlight color and/or dual highlight color printing. The depopulated image forming device may contain one charging substation, one exposing substation and one developing substation for the first highlight color feature of the image; two charging substations, one exposing substation and one developing substation for the second highlight color feature of the image and two charging substations, one exposing substation and one developing substation for the monochrome feature of the image, for example. As a result, the rate of image generation can be increased to approximately 133–166 pages per minute. In various other exemplary embodiments, speeds greater than 166 pages per minute may be reached. As mentioned above, the multiplicity of functionally-equivalent substations working in tandem to generate a single image compensates for the increased belt rate and subsequent decrease in time spent at a particular substation.

FIG. 1 is a generalized block diagram of a known full color image forming device 100. The full color image forming device 100 is connectable to an image data source 90 over a signal line or link 95. The image data source 90 provides input image data to the full color image forming device 100.

In general, the image data source 90 can be any one or more of a number of different sources, such as a scanner, a digital copier, a facsimile device that is suitable for generating electronic image data, or a device suitable for storing and/or transmitting electronic image data, such as a client or server of a network, such as the Internet, and especially the World Wide Web, for example. Thus, the image data source 90 can be any known or later-developed source that is capable of providing image data to the full color image forming device 100. The signal line or link 95 can be implemented using a public switched telephone network, a local or wide area network, an intranet, the Internet, a wireless transmission channel, or any other known or later-developed distributed network, or the like.

When the image data source 90 is a personal computer, the link 95 connecting the image data source 90 to the full color image forming device 100 can be a direct link between the personal computer and the full color image forming device 100. The link 95 can also be a local area network, a wide area network, the Internet, an intranet, or any other distributed processing and storage network. Moreover, the link 95 can also be a wireless link to the image data source 90. Accordingly, it should be appreciated that the image data source 90 can be connected using any known or later-developed system that is capable of transmitting data from the image data source 90 to the full color image forming device 100.

The image data provided by the image data source 90 is received by the input/output interface 105. The image data from the input/output interface 105, under the control of the controller 110, is forwarded either directly to the appropriate station or is initially stored in the memory 107. If the image data first is stored in the memory 107, the controller 110 can subsequently forward the image data from the memory 107 to the appropriate station.

The memory 107 can be implemented using any appropriate combination of alterable, volatile or non-volatile, memory; or non-alterable or fixed memory. The alterable memory, whether volatile or non-volatile, can be implemented using any one or more of static or dynamic RAM, a floppy disk and disk drive, a writeable or re-writeable optical disk and disk drive, a hard drive, flash memory or the like. Similarly, the non-alterable or fixed memory can be implemented using any one or more of ROM, PROM, EPROM, EEPROM, an optical ROM disk, such as a CD-ROM or DVD-ROM disk, and disk drive or the like.

It should be appreciated that, while the electronic image data can be generated at the time of printing an image from an original physical document, the electronic image data could have been generated at any time in the past. Moreover, the electronic image data need not have been generated from the original physical document, but could have been created from scratch electronically. The image data source 90 is thus any known or later developed device which is capable of supplying electronic image data over the link 95 to the full color image forming device 100. The link 95 can thus be any known or later developed system or device for transmitting the electronic image data from the image data source 90 to the full color image forming device 100.

A known full color image forming device prints cyan, magenta, yellow and black and white. These four colors are typically generated separately at stations 2–5, 130–160, respectively. Station 1 120 may be used for custom color toner, or not at all. If station 1 120 is not used, it is still retained in the architecture of the full color image forming device. Substations for charging, exposing and developing the different color images are located in each of stations 1 (121–123, respectively), station 2 (131–133, respectively), station 3 (141–143, respectively), station 4 (151–153, respectively) and station 5 (161–163, respectively).

Figure 2:
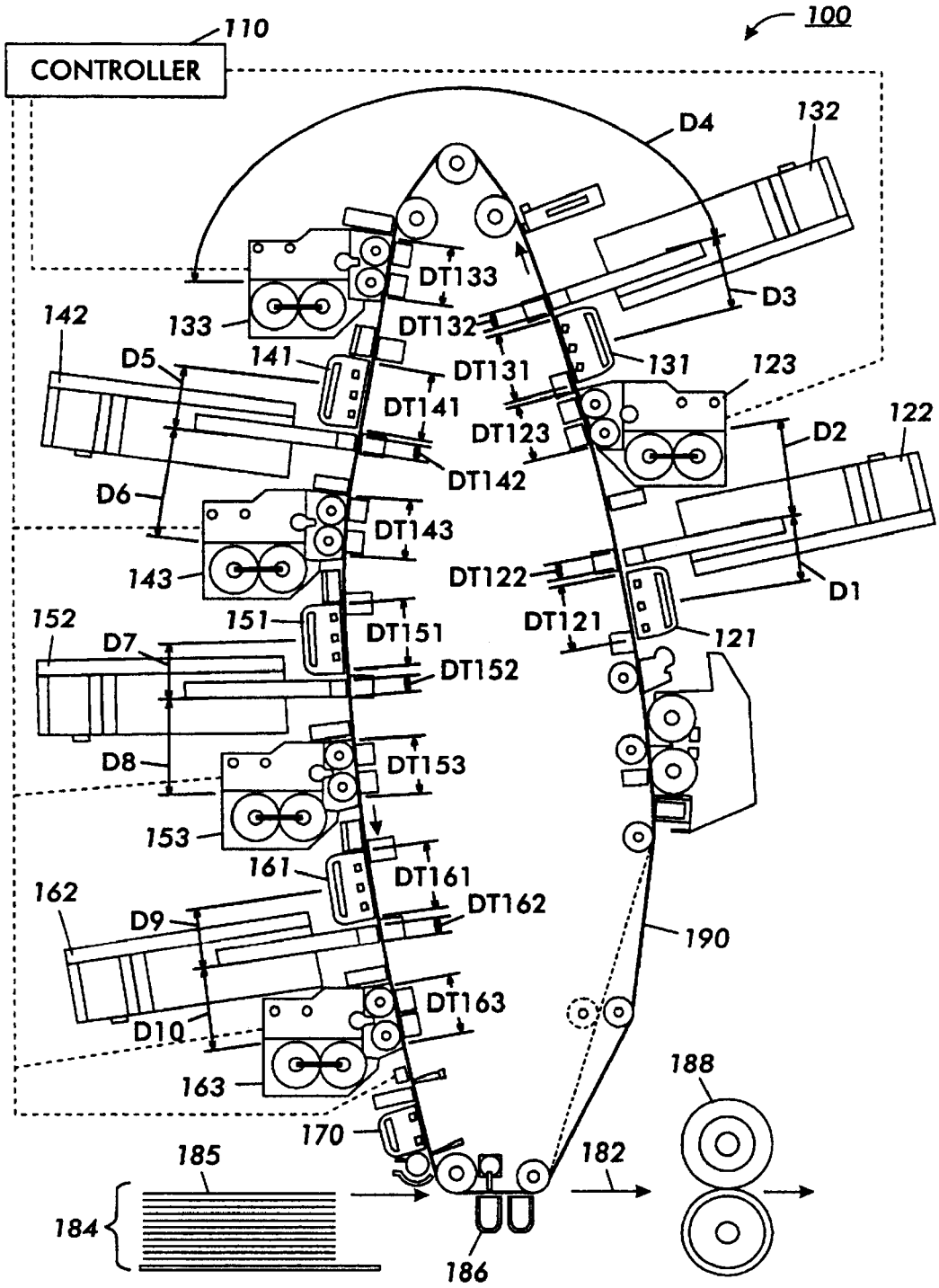
FIG. 2 (PRIOR ART)
FIG. 2 is a schematic diagram of one exemplary embodiment of the known full color image forming device of FIG. 1.

FIG. 2 is a schematic diagram of one exemplary embodiment 200 of the known full color image forming device 100 of FIG. 1. The photoconductive belt 190 moves, in a counterclockwise direction, through the various substations located along the circumference of the photoconductive belt 190. The charging substation 121 charges the photoconductive belt 190. The charged photoconductive belt 190 travels a distance DT121 through the charging substation 121. The charged photoconductive belt 190 then travels a distance D1 to reach the exposing substation 122. In various exemplary embodiments, the speed of the photoconductive belt 190 and the distance D1 between the exposing substation 122 and the charging substation 121 are predetermined to allow uniform charging of the portion of the photoconductive belt 190.

The exposing substation 122 exposes a portion of the photoconductive belt 190. The portion of the photoconductive belt 190 travels a distance DT122 through the exposing substation 122. The portion of the photoconductive belt 190 then travels a distance D2 to reach the developing station 123. In various exemplary embodiments, the speed of the photoconductive belt 190 and the distance D2 between the developing substation 123 and the exposing substation 122 are predetermined to allow sufficient exposure of the portion of the photoconductive belt 190.

The developing substation 123 develops the first color toner image. The portion of the photoconductive belt 190 travels a distance DT123 through the developing substation 123. The speed of the photoconductive belt must allow sufficient development of the first color toner image over the distance DT123.

The photoconductive belt continues to move, in a counterclockwise direction, to the charging substation 131. The charging substation 131 charges the photoconductive belt 190. The charged photoconductive belt 190 travels a distance DT131 through the charging substation 131. The charged photoconductive belt 190 then travels a distance D3 to reach the exposing substation 132. In various exemplary embodiments, the speed of the photoconductive belt 190 and the distance D3 between the exposing substation 132 and the charging substation 131 are predetermined to allow uniform charging of the portion of the photoconductive belt 190.

The exposing substation 132 exposes a portion of the photoconductive belt 190, through the previously exposed latent image. The portion of the photoconductive belt 190 travels a distance DT132 through the exposing substation 132. The portion of photoconductive belt 190 then travels a distance D4 to reach the developing station 133. In various exemplary embodiments, the speed of the photoconductive belt 190 and the distance D4 between the developing substation 133 and the exposing substation 132 are predetermined to allow sufficient exposure of the portion of the photoconductive belt 190 through the previously exposed image.

The developing substation 133 develops the second color toner image. The portion of the photoconductive belt 190 travels a distance DT133 through the developing substation 133. The speed of the photoconductive belt must allow sufficient development of the second color toner image over the distance DT133.

The photoconductive belt continues to move, in a counterclockwise direction, to the charging substation 141. The substation 141 charges the photoconductive belt 190. The charged photoconductive belt 190 travels a distance DT141 through the charging substation 141. The charged photoconductive belt 190 then travels a distance D5 to reach the exposing substation 142. In various exemplary embodiments, the speed of the photoconductive belt 190 and the distance D5 between the exposing substation 142 and the charging substation 141 are predetermined to allow uniform charging the portion of the photoconductive belt 190.

The exposing substation 142 exposes a portion of the photoconductive belt 190, through the previously exposed latent images. The portion of the photoconductive belt 190 travels a distance DT142 through the exposing substation 142. The portion of the photoconductive belt 190 then travels a distance D6 to reach the developing station 143. In various exemplary embodiments, the speed of the photoconductive belt 190 and the distance D6 between the developing substation 143 and the exposing substation 142 are predetermined to allow sufficient exposure of the portion of the photoconductive belt 190 through the previously exposed images.

The developing substation 143 develops the third color toner image. The portion of the photoconductive belt 190 travels a distance DT143 through the developing substation 143. The speed of the photoconductive belt must allow sufficient development of the third color toner image over the distance DT143.

The photoconductive belt continues to move, in a counterclockwise direction, to the charging substation 151. The charging substation 151 charges the photoconductive belt 190. The charged photoconductive belt 190 travels a distance DT151 through the charging substation 151. The charged photoconductive belt 190 then travels a distance D7 to reach the exposing substation 152. In various exemplary embodiments, the speed of the photoconductive belt 190 and the distance D7 between the exposing substation 152 and the charging substation 151 are predetermined to allow uniform charging of the portion of the photoconductive belt 190.

The exposing substation 152 exposes a portion of the photoconductive belt 190, through the previously exposed latent images. The portion of the photoconductive belt 190 travels a distance DT152 through the exposing substation 152. The portion of the photoconductive belt 190 then travels a distance D8 to reach the developing station 153. In various exemplary embodiments, the speed of the photoconductive belt 190 and the distance D8 between the developing substation 153 and the exposing substation 152 are predetermined to allow sufficient exposure of the portion of the photoconductive belt 190 through the previously exposed images.

The developing substation 153 develops the fourth color toner image. The portion of the photoconductive belt 190 travels a distance DT153 through the developing substation 153. The speed of the photoconductive belt must allow sufficient development of the fourth color toner image over the distance DT153.

In this schematic diagram of one exemplary embodiment of the known full color image forming device 100 of FIG. 1, a fifth set of charging, exposing and developing substations are present to generate a fifth color toner image. In this exemplary embodiment, the photoconductive belt continues to move in a counterclockwise direction to the charging substation 161. The charging substation 161 charges the photoconductive belt 190. The charged photoconductive belt 190 travels a distance DT161 through the charging substation 161. The charged photoconductive belt 190 then travels a distance D9 to reach the exposing substation 162. In various exemplary embodiments, the speed of the photoconductive belt 190 and the distance D9 between the exposing substation 162 and the charging substation 161 are predetermined to allow uniform charging of the portion of the photoconductive belt 190.

The exposing substation 162 exposes a portion of the photoconductive belt 190, through the previously exposed latent images. The portion of the photoconductive belt 190 travels a distance DT162 through the exposing substation 162. The portion of the photoconductive belt 190 then travels a distance D10 to reach the developing station 163. In various exemplary embodiments, the speed of the photoconductive belt 190 and the distance D10 between the developing substation 163 and the exposing substation 162 are predetermined to allow sufficient exposure of the portion of the photoconductive belt 190 through the previously exposed images.

The developing substation 163 develops the fifth color toner image. The portion of the photoconductive belt 190 travels a distance DT163 through the developing substation 163. The speed of the photoconductive belt must allow sufficient development of the fifth color toner image over the distance DT163.

It should be appreciated that the rate at which the belt may move through the stations is a function of the time required at each substation (i.e., dwell time), the distance through each substation and the distance between the substations within a particular station.

It should also be appreciated that the fifth set of charging, exposing and developing substations are not required to generate the full color image. These substations may be physically present and unused. In various exemplary embodiments, charging substation 121, exposing substation 122 and developing substation 123 are the substations reserved for an optional fifth color.

Upon development of the image, the photoconductive belt 190 continues to move, in a counterclockwise direction, through the pre-transfer station 170. The pre-transfer station 170 prepares the image for transfer to a recording material 185 at the transfer station 186. The recording material 185 is fed by the recording material housing 184 to the transfer station 186, where the image is transferred from the photoconductive belt 190 to the recording material 185. The recording material 185 then moves in the direction of 182 to the fixing device 188. The fixing device 188 receives the recording material 185 and fixes, at least semi-permanently, the image onto the recording material 185.

Figure 3:
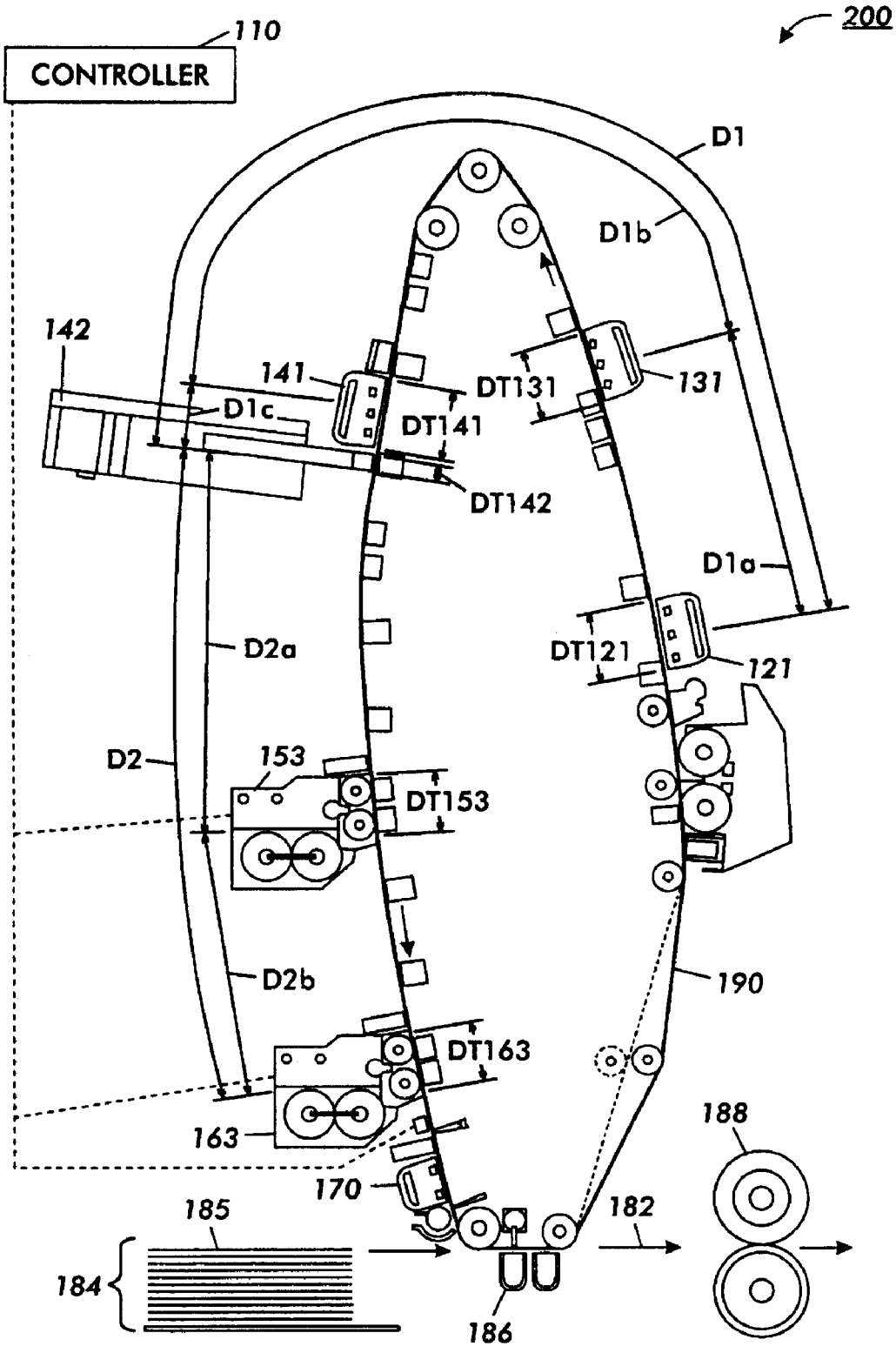
FIG. 3 is a schematic diagram outlining one exemplary embodiment of the image forming device of FIG. 1 depopulated and/or repopulated for high speed monochrome printing according to this invention.

FIG. 3 is a schematic diagram outlining one exemplary embodiment 300 of the image forming device 100 of FIG. 1 depopulated and/or repopulated for high speed monochrome printing according to this invention. In this exemplary embodiment, the photoconductive belt 190 moves, in a counterclockwise direction, through the various substations located along the circumference of the photoconductive belt 190. The charging substation 121 charges the photoconductive belt 190. The charged photoconductive belt 190 travels a distance DT121 through the charging substation 121.

The charged photoconductive belt 190 then travels a distance D1 a to reach a second charging substation 131. The charging substation 131 charges the photoconductive belt 190, for a second time. The charged photoconductive belt 190 travels a distance DT131 through the charging substation 131. The charged photoconductive belt 190 then travels a distance D1*b* to reach a third charging substation 141. The charging substation 141 charges the photoconductive belt 190, for a third time. The charged photoconductive belt 190 travels a distance DT141 through the charging substation 141.

The charged photoconductive belt 190 then travels a distance D1*c* to reach the exposing substation 142. The total distance traveled by the photoconductive belt 190, from the first charging substation 121 to the exposing substation 142, is D1. In various exemplary embodiments, the speed of the photoconductive belt 190 and the distances D1*a*, D1*b*, D1*c* and D1 are predetermined to allow uniform charging of the portion of the photoconductive belt 190.

In this exemplary embodiment, a multiplicity of charging substations are used in tandem to ensure uniform charge of the photoconductive belt 190 at higher belt speeds, compared to a full color image forming device, to compensate for a decreased amount of time spent at any single charging substation.

The exposing substation 142 exposes a portion of the photoconductive belt 190. The portion of the photoconductive belt 190 travels a distance DT142 through the exposing substation 142. The portion of the photoconductive belt 190 then travels a distance D2*a* to reach the developing station 153. In various exemplary embodiments, the speed of the photoconductive belt 190 and the distance D2*a* between the developing substation 153 and the exposing substation 142 are predetermined to allow sufficient exposure of the portion of the photoconductive belt 190.

The developing substation 153 develops the monochrome image. The portion of the photoconductive belt 190 travels a distance DT153 through the developing substation 153. The portion of the photoconductive belt 190 continues over a distance of D2*b* to a second developing substation 163. The developing substation 163 further develops the monochrome image. The portion of the photoconductive belt 190 travels a distance DT163 through the developing substation 163. The speed of the photoconductive belt must allow sufficient development of the monochrome image over the distances D153 and DT 163.

In this exemplary embodiment, a multiplicity of developing substations are used in tandem to ensure sufficient development of a monochrome image at higher belt speeds, compared to a full color image forming device, to compensate for a decreased amount of time spent at any single developing substation.

Figure 4:
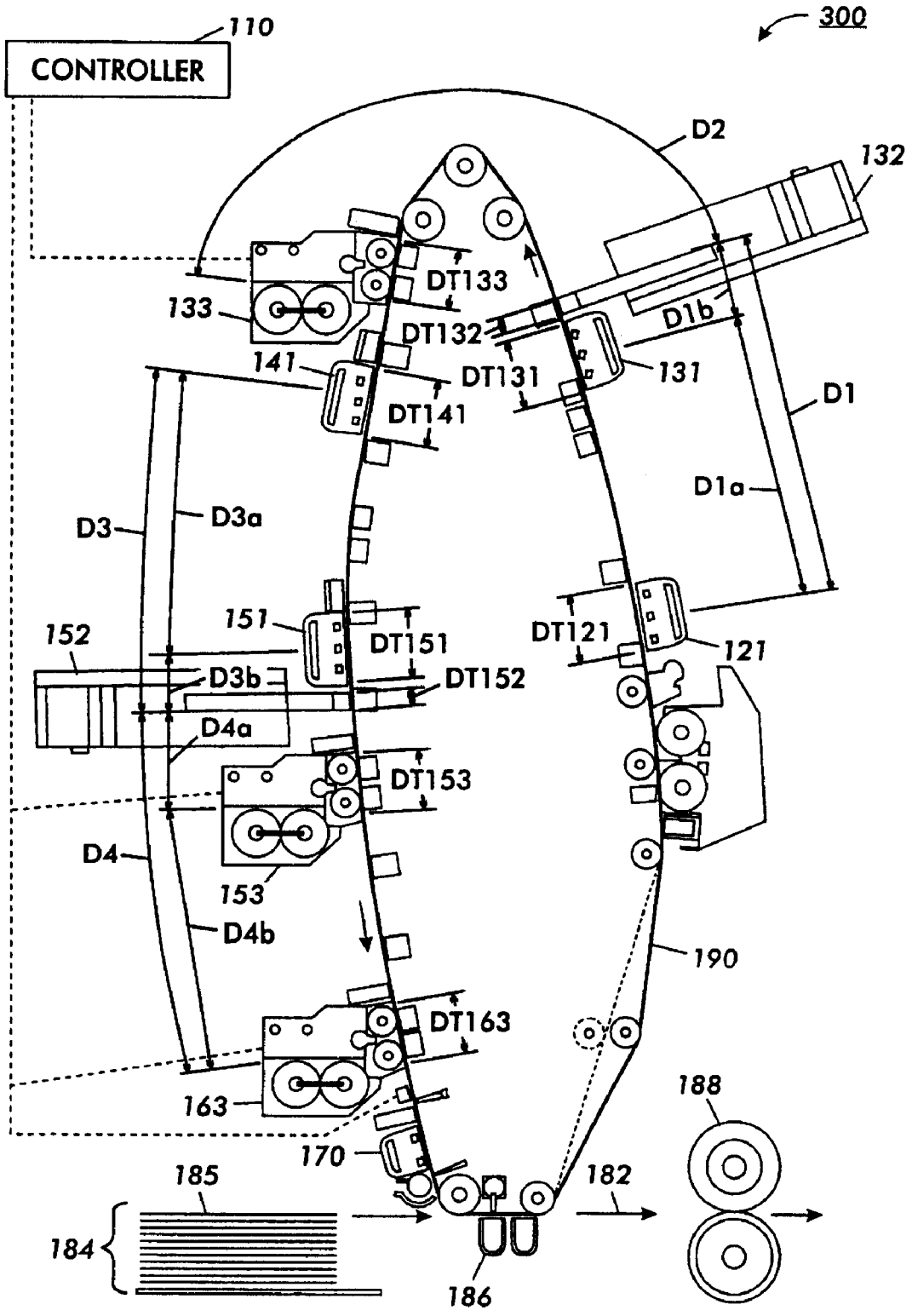
FIG. 4 is a schematic diagram outlining one exemplary embodiment of the image forming device of FIG. 1 depopulated and/or repopulated for high speed monochrome and/or single highlight color printing according to this invention.

FIG. 4 is a schematic diagram outlining one exemplary embodiment 400 of a the image forming device 100 of FIG. 1 depopulated and/or repopulated for high speed monochrome and/or single highlight color printing according to this invention. In this exemplary embodiment, the photoconductive belt 190 moves, in a counterclockwise direction, through the various substations located along the circumference of the photoconductive belt 190. The charging substation 121 charges the photoconductive belt 190. The charged the photoconductive belt 190 travels a distance DT121 through the charging substation 121. The photoconductive belt 190 then travels a distance D1*a* to reach a second charging substation 131. The charging substation 131 charges the photoconductive belt 190 for a second time. The charged photoconductive belt 190 travels a distance DT131 through the charging substation 131.

The charged photoconductive belt 190 then travels a distance D1*b* to reach the exposing substation 132. The total distance traveled by the first portion of the photoconductive belt 190, from the first charging substation 121 to the exposing substation 132, is D1. In various exemplary embodiments, the speed of the photoconductive belt 190 and the distances D1*a*, D1*b* and D1 are predetermined to allow uniform charging of the first portion of the photoconductive belt 190.

In this exemplary embodiment, a multiplicity of charging substations are used in tandem to ensure uniform charge of the photoconductive belt 190 at higher belt speeds, compared to a full color image forming device, to compensate for a decreased amount of time spent at any single charging substation.

The exposing substation 132 exposes a first portion of the photoconductive belt 190. The first portion of the photoconductive belt 190 travels a distance DT132 through the exposing substation 132. The first portion of the photoconductive belt 190 then travels a distance D2 to reach the developing station 133. In various exemplary embodiments, the speed of the photoconductive belt 190 and the distance D2 between the developing substation 133 and the exposing substation 132 are predetermined to allow sufficient exposure of the first portion of the photoconductive belt 190.

The developing substation 133 develops the single highlight color image. The first portion of the photoconductive belt 190 travels a distance DT133 through the developing substation 133. The speed of the photoconductive belt must allow sufficient development of the single highlight color image over the distance DT133.

The photoconductive belt continues to move, in a counterclockwise direction, to the charging substation 141. The charging substation 141 charges the photoconductive belt 190. The charged photoconductive belt 190 travels a distance DT141 through the charging substation 141. The charged photoconductive belt 190 then travels a distance D3*a* to reach a second charging substation 151. The charging substation 151 charges the photoconductive belt 190 for a second time. The charged photoconductive belt 190 travels a distance DT151 through the charging substation 151.

In this exemplary embodiment, a multiplicity of charging substations are used in tandem to ensure uniform charge of the photoconductive belt 190 at higher belt speeds, compared to a full color image forming device, to compensate for a decreased amount of time spent at any single charging substation.

The charged photoconductive belt 190 then travels a distance D3*b* to reach the exposing substation 152. The exposing substation 152 exposes a second portion of the photoconductive surface 190. The total distance between the exposing substation 152 and the charging substation 141 is D3. The second portion of the photoconductive belt 190 then travels a distance D4*a* to reach the developing station 153. In various exemplary embodiments, the speed of the photoconductive belt 190 and the distance D3 (which includes the distances D3*a* and D3*b*) between the exposing substation 152 and the charging substation 141 are predetermined to allow uniform charging of the second portion of the photoconductive belt 190.

The developing substation 153 develops the monochrome image. The second portion of the photoconductive belt 190 travels a distance DT153 through the developing substation 153. The second portion of the photoconductive belt 190 continues over a distance of D4*b* to a second developing substation 163. The developing substation 163 further develops the monochrome image. The second portion of the photoconductive belt 190 travels a distance DT163 through the developing substation 163. The speed of the photoconductive belt must allow sufficient development of the monochrome image over the distances D153 and DT163.

In this exemplary embodiment, a multiplicity of developing substations are used in tandem to ensure sufficient development of a monochrome image at higher belt speeds, compared to a full color image forming device, to compensate for a decreased amount of time spent at any single developing substation.

Figure 5:
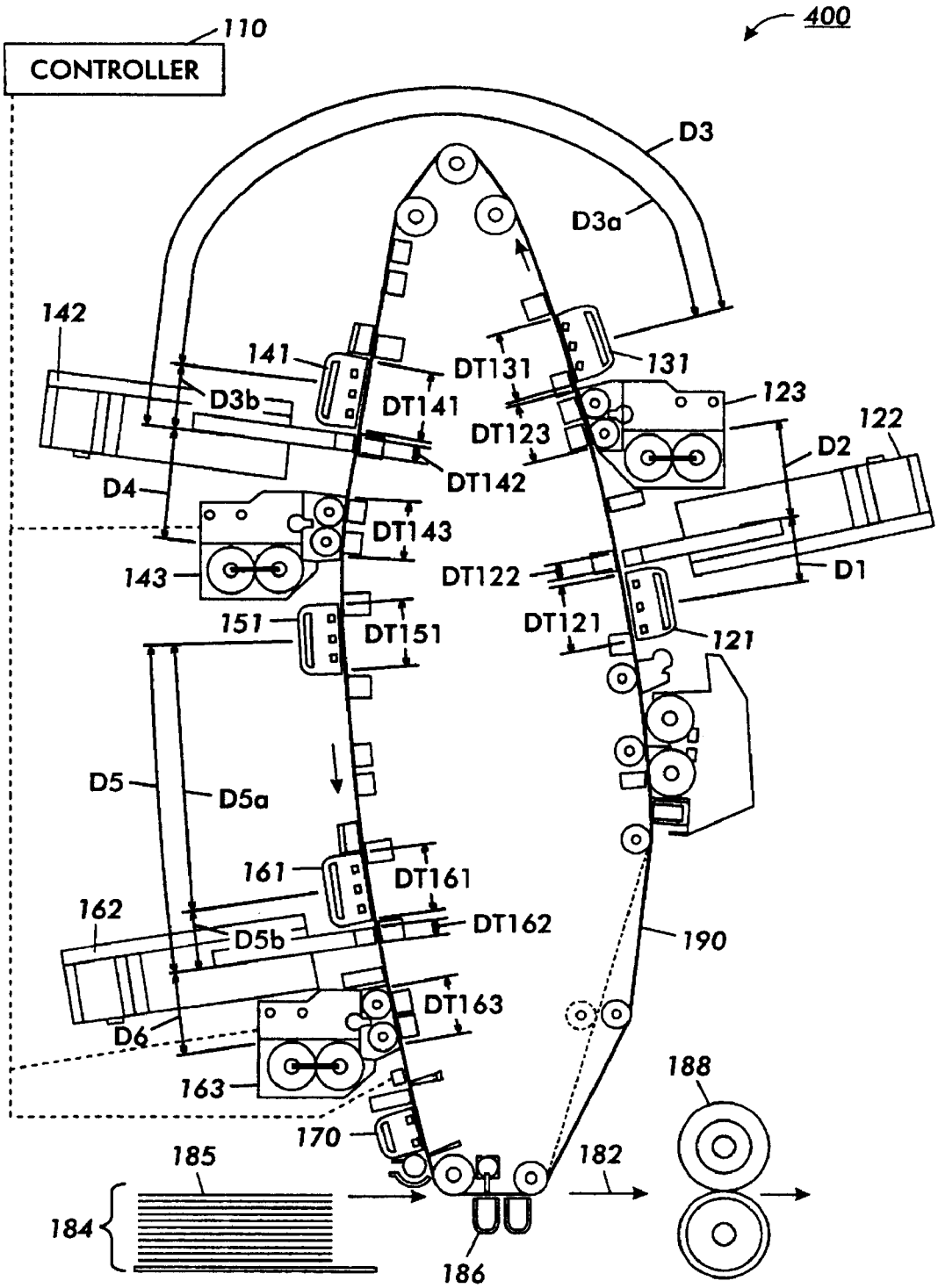
FIG. 5 is a schematic diagram outlining one exemplary embodiment of the image forming device of FIG. 1 depopulated and/or repopulated for high speed monochrome, single highlight color and/or dual highlight color printing according to this invention.

FIG. 5 shows is a schematic diagram outlining one exemplary embodiment of the image forming device of FIG. 1 depopulated and/or repopulated for high speed monochrome, single highlight color and/or dual highlight color printing according to this invention. The photoconductive belt 190 moves, in a counterclockwise direction, through the various substations located along the circumference of the photoconductive belt 190. The charging substation 121 charges the photoconductive belt 190. The charged photoconductive belt 190 travels a distance DT121 through the charging substation 121. The charged photoconductive belt 190 then travels a distance D1 to reach the exposing substation 122. In various exemplary embodiments, the speed of the photoconductive belt 190 and the distance D1 between the exposing substation 122 and the charging substation 121 are predetermined to allow uniform charging of the photoconductive belt 190.

The exposing substation 122 exposes a first portion of the photoconductive belt 190. The first portion of the photoconductive belt 190 travels a distance DT122 through the exposing substation 122. The first portion of the photoconductive belt 190 then travels a distance D2 to reach the developing station 123. In various exemplary embodiments, the speed of the photoconductive belt 190 and the distance D2 between the developing substation 123 and the exposing substation 122 are predetermined to allow sufficient exposure of the charged portion of the photoconductive belt 190.

The developing substation 123 develops the first highlight color image. The first portion of the photoconductive belt 190 travels a distance DT123 through the developing substation 123. The speed of the photoconductive belt must allow sufficient development of the first highlight color image over the distance DT123.

The photoconductive belt continues to move, in a counterclockwise direction, to the charging substation 131. The charging substation 131 charges the photoconductive belt 190. The charged photoconductive belt 190 travels a distance DT131 through the charging substation 131. The charged photoconductive belt 190 then travels a distance D3*a* to reach a second charging substation 141. The charging substation 141 charges t the photoconductive belt 190 for a second time. The charged photoconductive belt 190 travels a distance DT141 through the charging substation 141.

The charged photoconductive belt 190 then travels a distance D3*b* to reach the exposing substation 142. The total distance traveled by the photoconductive belt 190 from the first charging substation 131 to the exposing substation 142 is D3. In various exemplary embodiments, the speed of the photoconductive belt 190 and the distance D3 (which includes the distances D3*a* and D3*b*) are predetermined to allow uniform charging of the second portion of the photoconductive belt 190.

In this exemplary embodiment, a multiplicity of charging substations are used in tandem to ensure uniform charge of the photoconductive belt 190 at higher belt speeds, compared to a full color image forming device, to compensate for a decreased amount of time spent at any single charging substation.

The exposing substation 142 exposes a second portion of the photoconductive belt 190. The second portion of the photoconductive belt 190 travels a distance DT142 through the exposing substation 142. The second portion of the photoconductive belt 190 then travels a distance D4 to reach the developing station 143. In various exemplary embodiments, the speed of the photoconductive belt 190 and the distance D4 between the developing substation 143 and the exposing substation 142 are predetermined to allow sufficient exposure of the second portion of the photoconductive belt 190.

The developing substation 143 develops the second highlight color image. The second portion of the photoconductive belt 190 travels a distance DT143 through the developing substation 143. The speed of the photoconductive belt must allow sufficient development of the second color toner image over the distance DT143.

The photoconductive belt continues to move, in a counterclockwise direction, to the charging substation 151. The charging substation 151 charges the photoconductive belt 190. The charged photoconductive belt 190 travels a distance DT151 through the charging substation 151. The charged photoconductive belt 190 then travels a distance D5*a* to reach a second charging substation 161. The charging substation 161 charges the photoconductive belt 190 for a second time. The charged photoconductive belt 190 travels a distance DT161 through the charging substation 161.

The charged photoconductive belt 190 then travels a distance D5*b* to reach the exposing substation 162. The total distance traveled by the photoconductive belt 190 from the first charging substation 151 to the exposing substation 162 is D5. In various exemplary embodiments, the speed of the photoconductive belt 190 and the distance D5 (which includes the distances D5*a* and D5*b*) are predetermined to allow uniform charging of the photoconductive belt 190.

In this exemplary embodiment, a multiplicity of charging substations are used in tandem to ensure uniform charge of the photoconductive belt 190 at higher belt speeds, compared to a full color image forming device, to compensate for a decreased amount of time spent at any single charging substation.

The exposing substation 162 exposes a third portion of the photoconductive belt 190 to a latent image of the input image. The third portion of the photoconductive belt 190 travels a distance DT162 through the exposing substation 162. The third portion of the photoconductive belt 190 then travels a distance D6 to reach the developing station 163. In various exemplary embodiments, the speed of the photoconductive belt 190 and the distance D6 between the developing substation 163 and the exposing substation 162 are predetermined to allow sufficient exposure of the third portion of the photoconductive belt 190.

The developing substation 163 develops the monochrome image. The third portion of the photoconductive belt 190 travels a distance DT163 through the developing substation 163. The speed of the photoconductive belt must allow sufficient development of the monochrome image over the distance DT163.

It should be appreciated that the rate at which the belt may move through the stations is a function of the time required at each substation (i.e., dwell time), the distance through each substation and the distance between the substations within a particular station.

Figure 6:
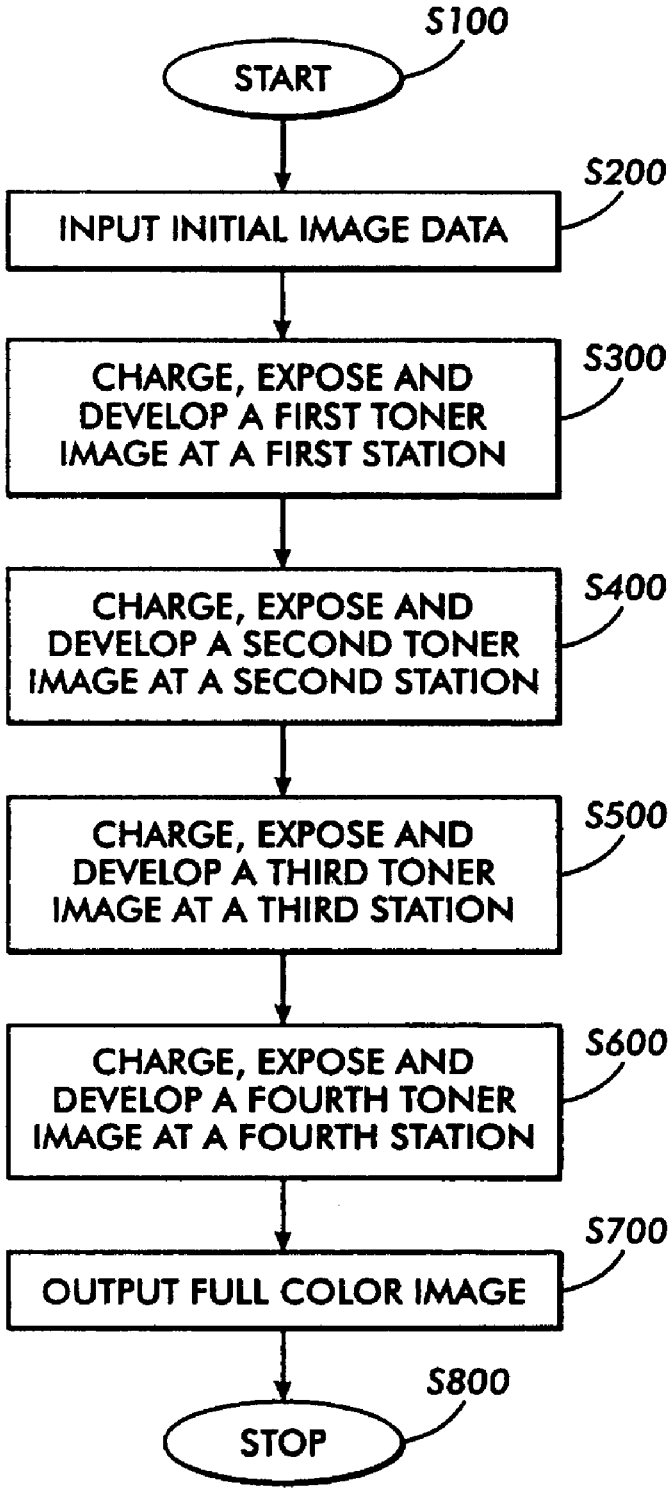
FIG. 6 (PRIOR ART)
FIG. 6 is a flowchart outlining a method for generating full color images using a full color image forming device.

FIG. 6 is a flowchart outlining a method for generating full color images using a full color image forming device. Beginning in step S100, the operation proceeds to step S200, where initial image data is input. Then, in step S300, the photoconductive surface is charged, exposed and a first color toner image is developed at a first station. Next, in step S400, the photoconductive surface is charged, exposed and a second toner color image is developed at a second station. Operation then continues to step S500.

In step S500, the photoconductive surface is charged, exposed and a third toner color image is developed at a third station. Then, in step S600, the photoconductive surface is charged, exposed and a fourth toner color image is developed at a fourth station. Next, in step S700, the final image is output. Operation of the method continue to step S800, where operation of the method stops.

Figure 7:
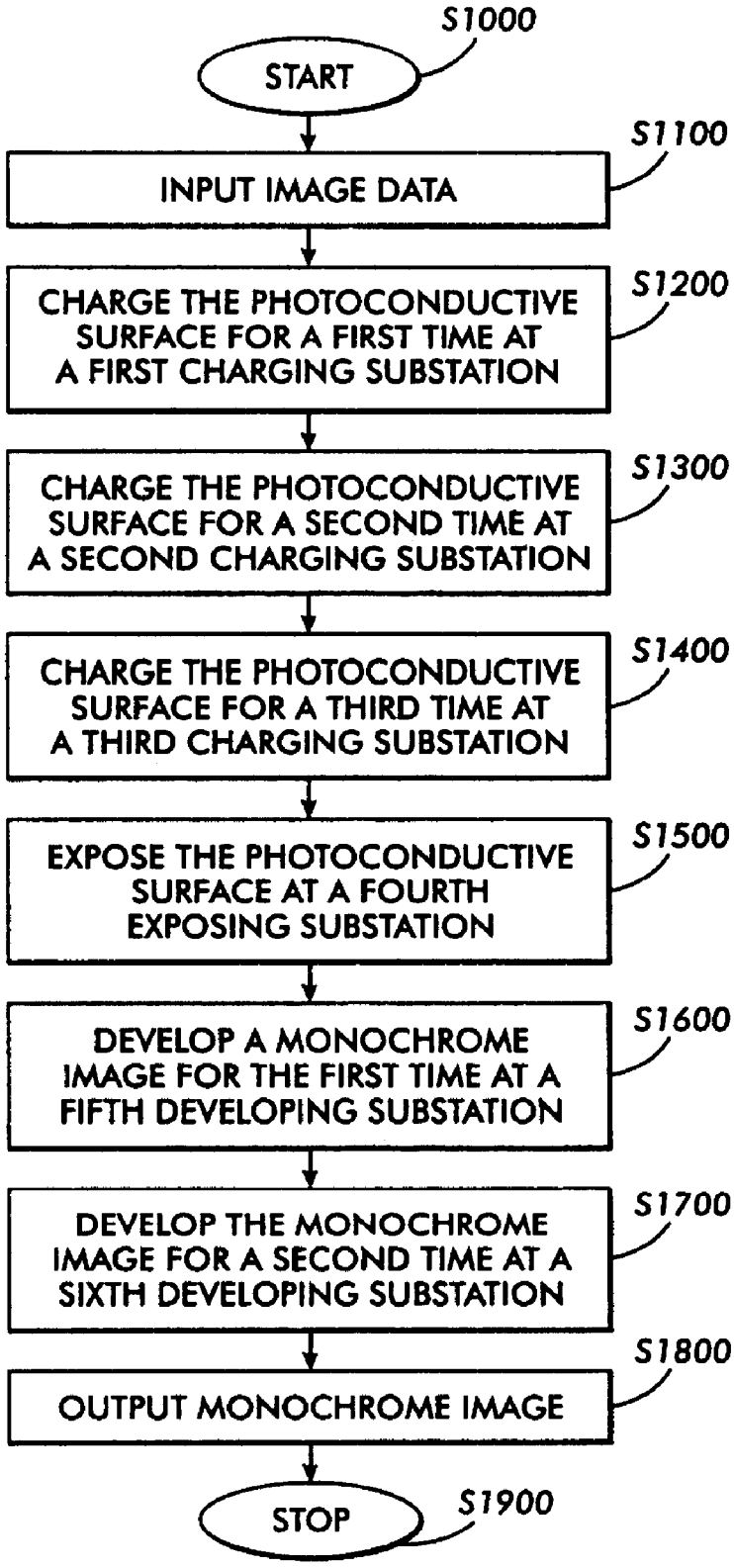
FIG. 7 is a flowchart outlining one exemplary embodiment of a method for generating monochrome images at high speed according to this invention using a first exemplary embodiment of a depopulated and/or repopulated image forming device.

FIG. 7 is a flowchart outlining one exemplary embodiment of a method for generating monochrome images at high speeds according to this invention using a first exemplary embodiment of a depopulated and/or repopulated image forming device. Beginning in step S1000, operation proceeds to step S1100, where initial image data is input. Then, in step S1200, the photoconductive surface is charged for a first time at a first charging substation. Next, in step S1300, the photoconductive surface is charged for a second time at a second charging substation. Operation then continues to step S1400.

In step S1400, the photoconductive surface is charged for a third time at a third charging substation. Then, in step S1500, the photoconductive surface is exposed at a fourth exposing substation. Next, in step S1600, a monochrome image is developed for a first time at a fifth developing substation. Operation then continues to step S1700.

In step S1700, the monochrome image is developed for a second time at a sixth developing substation. Next, in step S1800, the monochrome image is output. Operation then continues to step S1900, where operation of the method stops.

Figure 8:
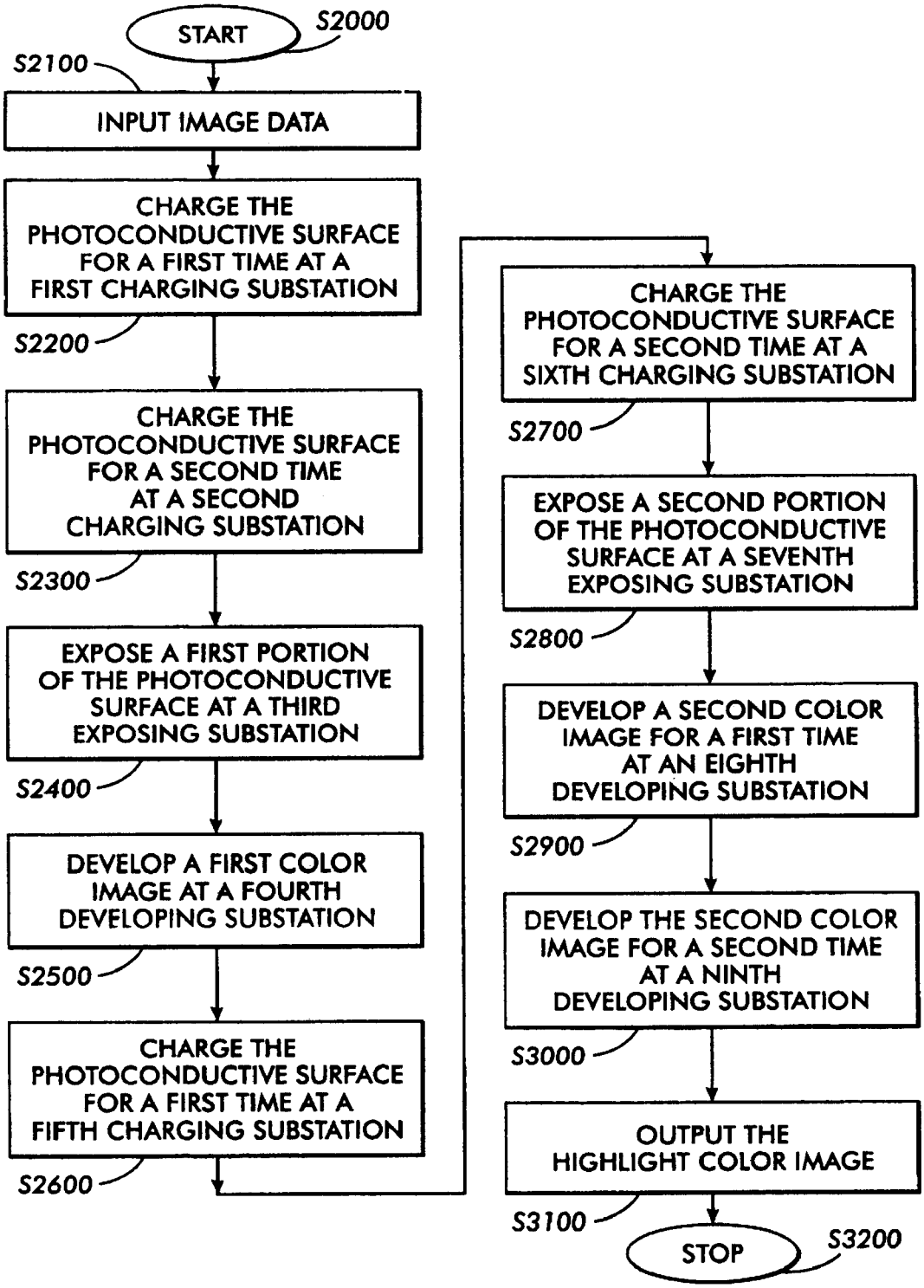
FIG. 8 is a flowchart outlining one exemplary embodiment of a method for generating monochrome and/or single highlight color images at high speed according to this invention using a second exemplary embodiment of a depopulated and/or repopulated image forming device.

FIG. 8 is a flowchart outlining one exemplary embodiment of a method for generating monochrome and/or single highlight color images at high speed according to this invention using a second exemplary embodiment of a depopulated/repopulated image forming device. Beginning on step S2000, operation proceeds to step S2100, where initial image data is input. Then, in step S2200, the photoconductive surface is charged for a first time at a first charging substation in step S2300, the photoconductive surface is charged for a second time at a second charging substation. Operation then continues to step S2400.

In step S2400, a first portion of the photoconductive surface is exposed at a third exposing substation. Then, in step S2500, a highlight color image is developed at a fourth developing substation. Next, in step S2600, the photoconductive surface is charged for a first time at a fifth charging substation. Operation then continues to step S2700.

In step S2700, the photoconductive surface is charged for a second time at a sixth charging substation. Then, in step S2800, a second portion of the photoconductive surface is exposed at a seventh exposing substation. Next, in step S2900, a monochrome image is developed for a first time at an eighth developing substation. Operation then continues to step S3000.

In step S3000, the monochrome image is developed for a second time at a ninth developing substation. Then, in step S3100, the monochrome image is output. Operation then continues to step S3200, where operation of the method stops.

Figure 9:
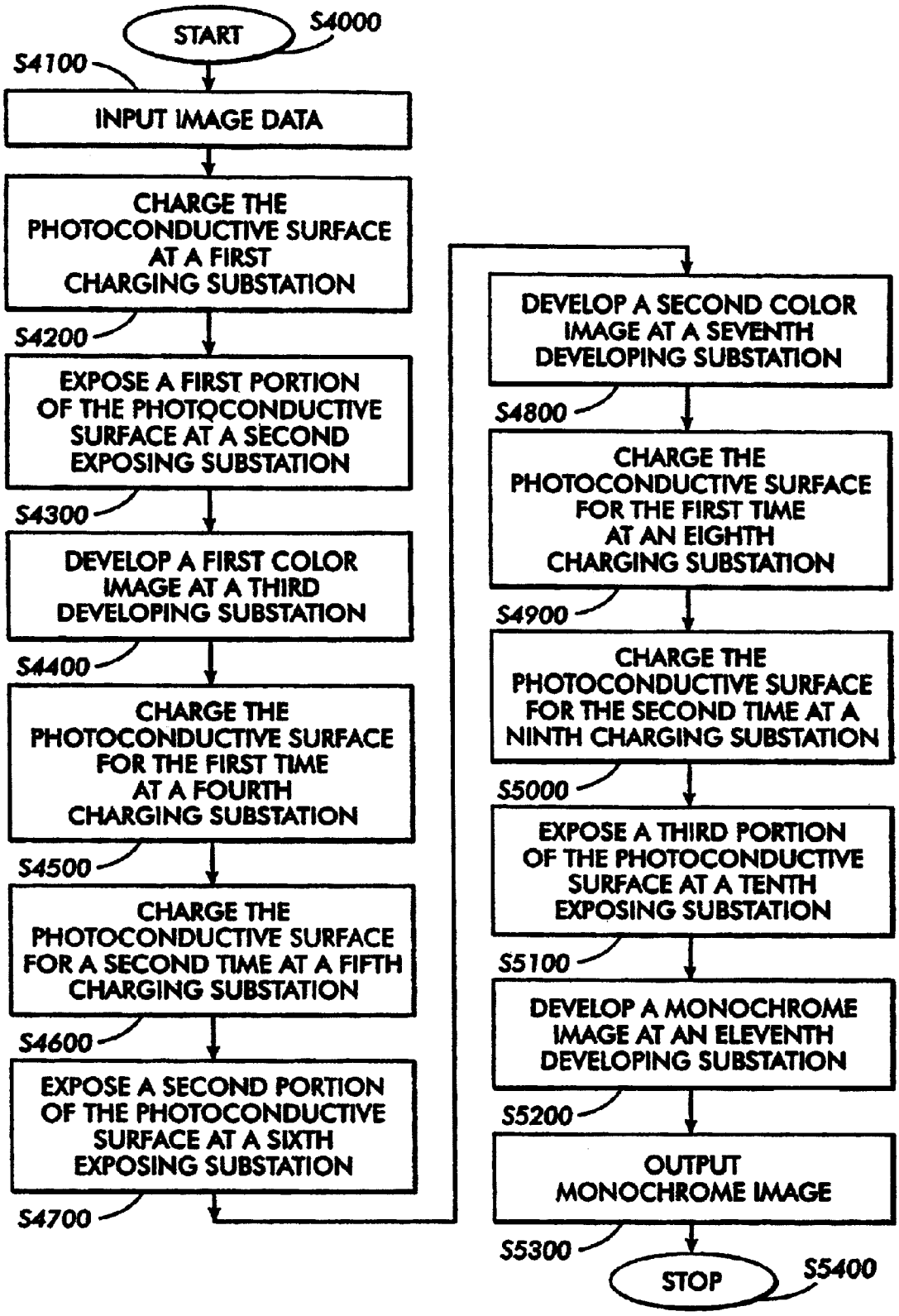
FIG. 9 is a flowchart outlining one exemplary embodiment of a method for generating monochrome, single highlight color and/or dual highlight color images at high speed according to this invention using a third exemplary embodiment of a depopulated and/or repopulated image forming device.

FIG. 9 is a flowchart outlining one exemplary embodiment of a method for generating monochrome, single highlight color and/or dual highlight color images at high speed according to this invention using a third exemplary embodiment of a depopulated and/or repopulated image forming device. Beginning on step S4000, operation proceeds to step S4100, where initial image data is input. Then, in step S4200, the photoconductive surface is charged at a first charging substation. Next, in step S4300, a first portion of the photoconductive surface is exposed at a second exposing substation. Operation then continues to step S4400.

In step S4400, a first highlight color image is developed at a third developing substation. Then, in step S4500, the photoconductive surface is charged for a first time at a fourth charging substation. Next, in step S4600, the photoconductive surface is charged for a second time at a fifth charging substation. Operation then continues to step S4700.

In step S4700, a second portion of the photoconductive surface is exposed at a sixth exposing substation. Then, in step S4800, a second highlight color image is developed at a seventh developing substation. Next, in step S4900, the photoconductive surface is charged for a first time at a seventh charging substation. Operation then continues to step S5000.

In step S5000, the photoconductive surface is charged for a second time at an eighth charging substation. Then, in step S5100, a third surface of the photoconductive surface is exposed at a ninth exposing substation. Next, in step S5200, monochrome image is developed at a tenth developing substation. Operation then continues to step S5300.

In step S5300, the monochrome image is output. Operation then continues to step S5400, where operation of the method stops.

While this invention has been described in conjunction with the exemplary embodiments outlined above, it is evident that many alternatives, modifications and variations will be apparent to those skilled in the art. Accordingly, the exemplary embodiments of the invention as set forth in above are intended to be illustrative not limiting. Various changes may be made without departing from the spirit and scope of the invention as defined in the following claims.

It should be appreciated that the full color image forming device of FIG. 2 may be adapted for the generation of monochrome images at high speed. For example, the fifth, unused, station can be depopulated so that only the developing substation is present and/or active. This developing substation may then be used in tandem with a second developing substation for generating a monochrome image at high speed.

It should also be appreciated that the exemplary embodiments detailed above can be combined to achieve a depopulated and/or repopulated image forming device for generating monochrome, single highlight color and/or dual highlight color printing at high speed. For example, if one were to combine the exemplary embodiment of FIG. 3 with that of FIG. 4, the resulting image forming device would be identical to that of FIG. 4, with the addition of exposing substation 142.

It should also be appreciated that the exemplary embodiments detailed above can be modified independently of each other to achieve a depopulated and/or repopulated image forming device for generating monochrome, single highlight color and/or dual highlight color printing at high speed. For example, it is possible to remove the charging substation 131 from FIG. 5 without preventing the generation monochrome, single highlight color and/or dual highlight color printing at high speed.

What is claimed is:

1. A method for generating at least one of monochrome, single highlight color and dual highlight color images, comprising:

increasing the speed of a full color print engine;

reducing the dwell time spent charging, exposing and/or developing a photoconductive surface; and compensating for the decrease in dwell time using at least one group of multiple, functionally-equivalent substations in tandem on the photoconductive surface.

2. The method according to claim 1, wherein at least one group of charging substations is used in tandem on an image.

3. The method according to claim 1, wherein at least two charging substations are used in tandem on an image.

4. The method according to claim 1, wherein at least one group of developing substations is used in tandem on an image.

5. The method according to claim 1, wherein at least two developing substations are used in tandem on an image.

6. The method according to claim 1, wherein at least one group of charging substations and at least one group of developing substations are used in tandem on an image.

7. The method according to claim 1, wherein at least 2 charging substations are used in tandem and at least 2 developing substations are used in tandem on an image.

8. The method according to claim 1 for generating monochrome images, comprising:

twice charging the photoconductive surface;

exposing a portion on photoconductive surface; and twice developing the monochrome image.

9. The method according to claim 1 for the high speed generation of monochrome and single highlight color image data, comprising:

twice charging the photoconductive surface, exposing a first portion on the photoconductive surface and developing the single highlight color image; and twice charging the circumference of the photoconductive surface, exposing a second portion on the photoconductive surface and twice developing the monochrome image.

10. The method according to claim 1 for the high speed generation of at least one of monochrome and dual highlight color images, comprising:

charging the photoconductive surface, exposing a first portion on the photoconductive surface and developing a first highlight color image;

charging the photoconductive surface, exposing a second portion on the photoconductive surface and developing a second highlight color image; and twice charging the photoconductive surface, exposing a third portion on the photoconductive surface and developing the monochrome image.

11. An apparatus for generating at least one of monochrome, single highlight color, and dual highlight color images, comprising:

selectively depopulated/repopulated stations of an electrophotographic print engine.

12. The apparatus according to claim 11, wherein multiple functionally-equivalent subsystems are positioned to act in tandem, compensate for a decrease in the amount of time a photoconductive surface spends at an individual subsystem.

13. The apparatus according to claim 11, comprising the following substations arranged sequentially along the circumference of a photoconductive belt:

two functionally equivalent charging substations;

an exposing substation station; and two functionally equivalent developing station.

14. The apparatus according to claim 11, comprising the following substations arranged sequentially along the circumference of a photoconductive belt:

two functionally equivalent charging substations, an exposing substation and a developing substation; and two functionally equivalent charging substations, an exposing substation and two functionally equivalent developing substations.

15. The apparatus according to claim 11, comprising the following substations arranged sequentially along the circumference of a photoconductive belt:

a charging substation, an exposing station and a developing station;

two functionally equivalent charging substations, an exposing station and a developing station; and two functionally equivalent charging substations, an exposing station and a developing station.

* * * * *